US011815330B2

(12) United States Patent
Mansfield

(10) Patent No.: US 11,815,330 B2
(45) Date of Patent: Nov. 14, 2023

(54) SIGHT APPARATUS FOR FIREARMS INSTRUCTION AND RELATED METHODS OF USE

(71) Applicant: Michael R. Mansfield, Sarasota, FL (US)

(72) Inventor: Michael R. Mansfield, Sarasota, FL (US)

( * ) Notice: Subject to any disclaimer, the term of this patent is extended or adjusted under 35 U.S.C. 154(b) by 444 days.

(21) Appl. No.: 16/997,876

(22) Filed: Aug. 19, 2020

(65) Prior Publication Data

US 2022/0057170 A1 Feb. 24, 2022

(51) Int. Cl.
*F41G 1/01* (2006.01)
*F41A 33/00* (2006.01)

(52) U.S. Cl.
CPC ..... *F41G 1/01* (2013.01); *F41A 33/00* (2013.01)

(58) Field of Classification Search
CPC ..... F41G 1/01; F41A 33/00
USPC ..... 434/19
See application file for complete search history.

(56) References Cited

U.S. PATENT DOCUMENTS

| | | | | |
|---|---|---|---|---|
| 1,051,164 | A | 1/1913 | Scott | |
| 1,292,211 | A | 1/1919 | Young | |
| 1,363,553 | A | 12/1920 | Moreau | |
| 1,818,381 | A | 8/1931 | Caruth | |
| 1,890,478 | A | 12/1932 | Wale | |
| 2,039,907 | A | 5/1936 | Jefferson | |
| 2,442,748 | A | 6/1948 | Albert | |
| 3,439,970 | A | 4/1969 | Rickert | |
| 4,245,402 | A * | 1/1981 | Lanese | F41A 33/00 434/19 |
| 5,638,604 | A | 6/1997 | Lorocco | |
| D382,038 | S | 8/1997 | Nigh | |
| 5,822,872 | A | 10/1998 | Waki | |
| 5,887,352 | A | 3/1999 | Kim | |
| 6,058,616 | A | 5/2000 | Bubits | |
| D428,102 | S | 7/2000 | Flubacher | |
| D428,103 | S | 7/2000 | Kiesler | |
| D429,790 | S | 8/2000 | Plonka | |
| D435,080 | S | 12/2000 | Ling, Jr. | |
| D435,282 | S | 12/2000 | Ling, Jr. | |
| D436,393 | S | 1/2001 | Ling, Jr. | |
| 6,216,351 | B1 | 4/2001 | Flubacher | |
| 6,360,471 | B1 | 3/2002 | Stein | |
| 6,421,946 | B1 | 7/2002 | Lorocco | |
| 6,739,873 | B1 * | 5/2004 | Rod | F41G 3/2611 434/19 |

(Continued)

OTHER PUBLICATIONS

U.S. Pat. No. 647,123, Frank P Warner Apr. 10, 1900.

*Primary Examiner* — Peter S Vasat
*Assistant Examiner* — Stephen Alvesteffer
(74) *Attorney, Agent, or Firm* — James A Cardle

(57) ABSTRACT

A method of firearm instruction may include the steps of substituting a rear sight for a standard rear sight and substituting a front sight for a standard front sight by securing the rear sight and the front sight to a firearm. The method may include viewing by an instructor simultaneously with viewing by the shooter the aligning of the rear sight with the front sight along the line of sight as the shooter is manipulating the firearm. A rear sight face of the rear sight and a front sight face of the front sight are sized greater than a standard rear sight face of the standard rear sight and a standard front sight face of the front sight.

9 Claims, 5 Drawing Sheets

(56) References Cited

U.S. PATENT DOCUMENTS

| | | | | |
|---|---|---|---|---|
| 6,804,908 | B1 * | 10/2004 | Hanson | F41G 1/52 42/111 |
| D512,118 | S | 11/2005 | Warren | |
| D512,761 | S | 12/2005 | Warren | |
| D515,170 | S | 2/2006 | Price | |
| D546,915 | S | 7/2007 | Price | |
| 7,287,351 | B1 | 10/2007 | Warren | |
| D565,144 | S | 3/2008 | Price | |
| 7,451,566 | B1 | 11/2008 | Price | |
| D584,788 | S | 10/2009 | Price | |
| 7,905,044 | B2 | 3/2011 | Clouser | |
| 8,037,634 | B2 | 10/2011 | Price | |
| D663,375 | S | 7/2012 | Glimpse | |
| D667,522 | S | 9/2012 | Glimpse | |
| D667,523 | S | 9/2012 | Glimpse | |
| D667,524 | S | 9/2012 | Glimpse | |
| D667,525 | S | 9/2012 | Glimpse | |
| 8,261,481 | B1 | 9/2012 | Shebaro | |
| D679,359 | S | 4/2013 | Adcock | |
| D679,360 | S | 4/2013 | Adcock | |
| 8,448,373 | B2 | 5/2013 | Matthews | |
| D687,915 | S | 8/2013 | Adcock | |
| 8,635,800 | B2 | 1/2014 | Glimpse | |
| 8,635,801 | B2 | 1/2014 | Glimpse | |
| 8,919,027 | B2 | 12/2014 | Curry | |
| 9,328,993 | B1 | 5/2016 | Heacock | |
| 9,360,278 | B2 | 6/2016 | Mansfield | |
| 9,464,868 | B2 | 10/2016 | Monaghan | |
| 9,562,743 | B1 | 2/2017 | Mansfield | |
| 9,658,030 | B1 | 5/2017 | Heacock | |
| D797,233 | S | 9/2017 | Howlett | |
| D801,468 | S | 10/2017 | Kedairy | |
| 10,365,065 | B1 * | 7/2019 | Smith | F41G 1/10 |
| 2004/0010956 | A1 | 1/2004 | Bubits | |
| 2007/0074441 | A1 | 4/2007 | Howe | |
| 2010/0077647 | A1 | 4/2010 | Kraft | |
| 2011/0067286 | A1 | 3/2011 | Price | |
| 2012/0144721 | A1 | 6/2012 | Glimpse | |
| 2015/0192390 | A1 | 7/2015 | Pedack | |
| 2016/0258715 | A1 * | 9/2016 | Grey | F41G 1/02 |
| 2019/0301828 | A1 * | 10/2019 | Biddle | F41A 33/00 |

* cited by examiner

SIGHT APPARATUS FOR FIREARMS INSTRUCTION AND RELATED METHODS OF USE

BACKGROUND OF THE INVENTION

Field

The apparatus and related methods disclosed herein are generally related to aiming devices particularly aiming devices used to aim a firearm or other projectile firing device.

Background

A shooter may aim a firearm at a target using a sight system. The sight system may consist of a front sight mounted toward the front (i.e. muzzle) of the firearm and a rear sight generally mounted toward the butt of the firearm. The shooter aims the firearm by viewing the, rear sight, the front sight, and the target, and then manipulating the firearm until the rear sight, the front sight, and the target are all in proper visual alignment. Once the rear sight, the front sight, and the target are properly aligned with one another, the user may then fire the firearm to hit the target.

Consistent proper visual sight alignment is necessary for the shooter to consistently hit the target. It takes skill developed by practice and training to accomplish consistent proper visual alignment of the rear sight, the front sight, and the target. The shooter, particularly a beginner, may be taught such consistent proper visual sight alignment by an instructor. Unfortunately, the instructor cannot view the alignment of the rear sight, front sight, and target as viewed by the shooter, so that it may be difficult for the instructor to correct improper sight alignment by the shooter. Accordingly, there is a need for improved apparatus as well as related methods of use that allow the instructor to view the alignment of the rear sight, front sight, and target as viewed by the shooter so that, for example, the instructor may correct improper sight alignment.

BRIEF SUMMARY OF THE INVENTION

These and other needs and disadvantages may be overcome by the apparatus and related methods of use disclosed herein. Additional improvements and advantages may be recognized by those of ordinary skill in the art upon study of the present disclosure.

A method of firearm instruction, as disclosed herein, may include the steps of substituting a rear sight for a standard rear sight and substituting a front sight for a standard front sight by securing the rear sight and the front sight to a firearm. In various aspects, the method may include the step of aligning the rear sight with the front sight along a line of sight by a shooter manipulating the firearm, and the step of viewing by an instructor simultaneously with viewing by the shooter the aligning of the rear sight with the front sight along the line of sight as the shooter is manipulating the firearm. A rear sight face of the rear sight and a front sight face of the front sight are sized greater than a standard rear sight face of the standard rear sight and a standard front sight face of the front sight for viewing of the aligning of the rear sight with the front sight along the line of sight by the shooter and by the instructor simultaneously, in various aspects.

This summary is presented to provide a basic understanding of some aspects of the apparatus and methods disclosed herein as a prelude to the detailed description that follows below. Accordingly, this summary is not intended to identify key elements of the apparatus and methods disclosed herein or to delineate the scope thereof.

Figure 1A:
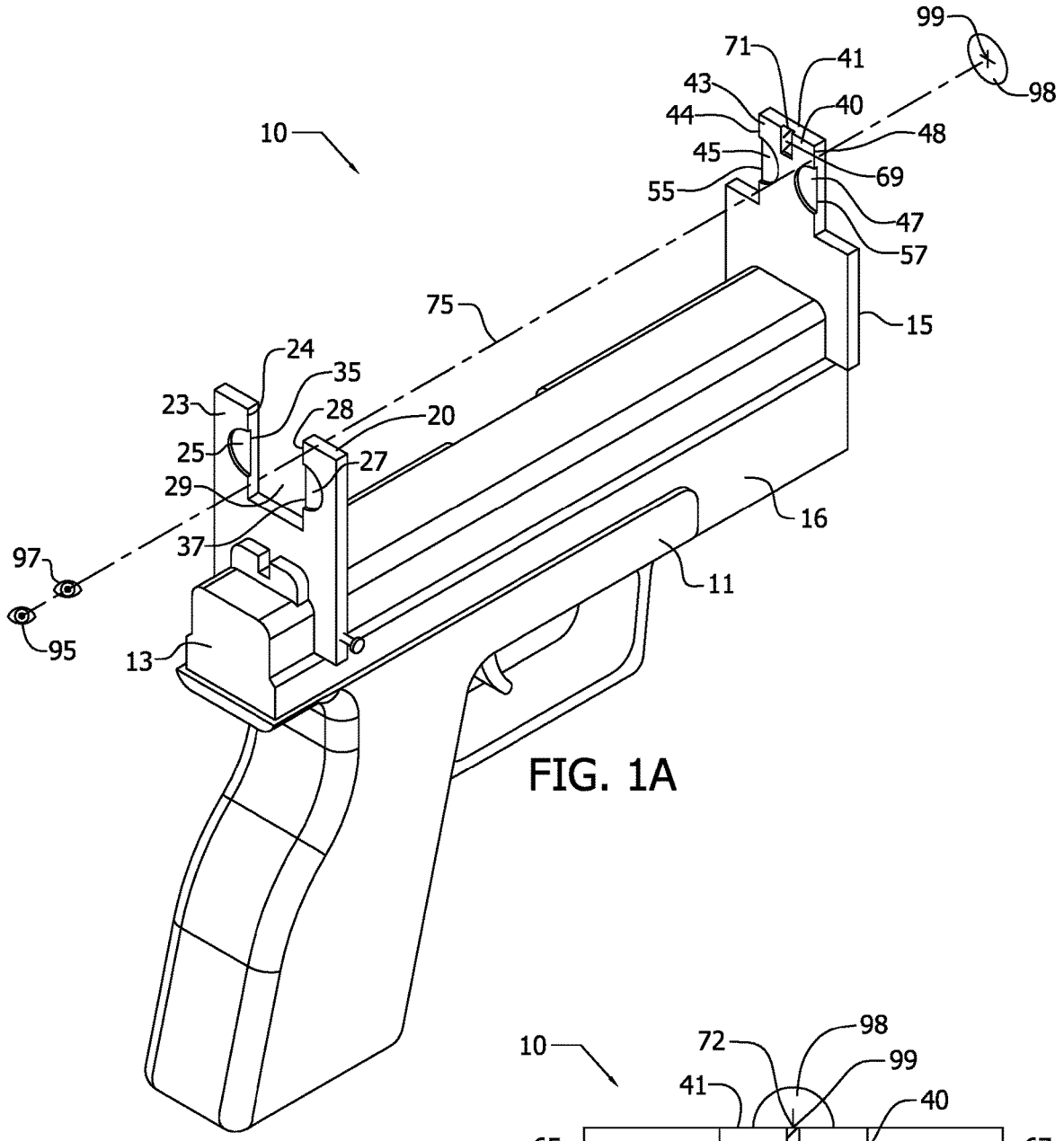
FIG. 1A illustrates by perspective view an exemplary implementation of a sight system according to the present inventions.

The Figures are exemplary only, and the implementations illustrated therein are selected to facilitate explanation. The number, position, relationship and dimensions of the elements shown in the Figures to form the various implementations described herein, as well as dimensions and dimensional proportions to conform to specific force, weight, strength, flow and similar requirements are explained herein or are understandable to a person of ordinary skill in the art upon study of this disclosure. Where used in the various Figures, the same numerals designate the same or similar elements. Furthermore, when the terms "top," "bottom," "right," "left," "forward," "rear," "first," "second," "inside," "outside," and similar terms are used, the terms should be understood in reference to the orientation of the implementations shown in the drawings and are utilized to facilitate description thereof. Use herein of relative terms such as generally, about, approximately, essentially, may be indicative of engineering, manufacturing, or scientific tolerances such as ±0.1%, ±1%, ±2.5%, ±5%, or other such tolerances, as would be recognized by those of ordinary skill in the art upon study of this disclosure.

DETAILED DESCRIPTION OF THE INVENTION

A method of firearm instruction is disclosed herein along with related apparatus. The method of firearms instructing includes substituting a rear sight for a standard rear sight and substituting a front sight for a standard front sight, in various aspects. A rear sight face of the rear sight and a front sight face of the front sight are oriented toward a shooter to be viewable by the shooter along a line of sight when the shooter aligns the rear sight and the front sight with the target, in various aspects. The rear sight face of the rear sight and the front sight face of the front sight are oversized to allow viewing by an instructor of the aligning by the shooter of the rear sight with the front sight and the target along the line of sight, in various aspects. The instructor may then instruct the shooter on proper alignment of the rear sight, the front sight, and the target. Note that the rear sight face (faces to the rear) of the rear sight and the front sight face (faces to the rear) of the front sight are oriented toward the shooter, as per the various implementations included in this disclosure.

The standard rear sight and standard front sight are of standard sizes as would be recognized by those of ordinary skill in the art upon study of this disclosure. The standard rear sight and the standard front sight, for example, may be mounted to the firearm by the manufacturer. Substituting the rear sight for the standard rear sight and substituting the front sight for the standard front sight may include attached the rear sight and the front sight to the firearm and may not require removal of the standard rear sight and the standard front sight. Thus, the rear sight and the front sight may be in addition to and not a replacement of the standard rear sight and standard front sight. Substituting in the context may mean using the rear sight in lieu of the standard rear sight and using the front sight in lieu of the standard front sight.

The rear sight, in various aspects, may be configured as a U-notch, Patridge, V-notch, express, or ghost ring. The front sight, in various aspects, may be configured as a post or a post with a bead. In certain aspects, the rear sight and the front sight may be configured generally as described in U.S. Pat. No. 9,360,278 issued 7 Jun. 2016 or in U.S. Pat. No. 9,562,743 issued 7 Feb. 2017. U.S. Pat. Nos. 9,360,278 and 9,562,743 are hereby incorporated by reference in their entireties herein.

In various aspects, the rear sight and the front sight may enhance instruction making proper sight alignment easier to learn or more obvious to the beginning shooter. The rear sight and the front sight may allow the instructor point to various features of the rear sight and the front sight thereby enhancing the instructor's ability to instruct. A rear sight face of the rear sight and a front sight face of the front sight may constitute display surfaces that may include one or more display elements in the form of, for example, lettering, numbering, symbols, and other graphical elements that may aid instruction. Thus, the rear sight and the front sight, in various aspects, may offer advantages that aid those with vision issues as seen, for example, in large key keyboards, large key phones, pill dispensers, etc.

FIG. 1A illustrates exemplary sight system 10 including rear sight 20 and front sight 40 affixed to firearm 11. Firearm 11 is illustrated in FIG. 1A as a pistol, but it should be understood that firearm 11 may include any of various individual firearms such as a rifle, shotgun, pistol, or carbine. In this implementation, rear sight 20 and front sight 40 of sight system 10 are set apart from one another, with rear sight 20 located generally proximate the butt 13 of firearm 11 and front sight 40 located generally proximate muzzle 15 of firearm 11. Shooter 97 and instructor 95 are positioned rearward of the firearm 11, as illustrated. As illustrated in FIG. 1A, rear sight 20 and front sight 40 are sized to allow instructor 95 to view the alignment of rear sight 20, front sight 40, and target 98 simultaneously with shooter 97 so that instructor 95 may evaluate shooter's 97 alignment of rear sight 20, front sight 40, and target 98.

As illustrated in FIG. 1A, shooter 97 views target 98 along line of sight 75 that passes through notch 29 of rear sight 20, encompasses at least portions of front sight face 43 of front sight 40, and at least portions of target 98. While line of sight 75 is depicted graphically in FIG. 1A by a single dash dot line, it should be recognized that line of sight 75 is indicative of a field of vision around the single dash dot line. In order to hit target 98 at center 99, firearm 11 is manipulated by the shooter 97 to align the rear sight 20, front sight 40, and target 98 as viewed by shooter 97 along line of sight 75.

Figure 1B:
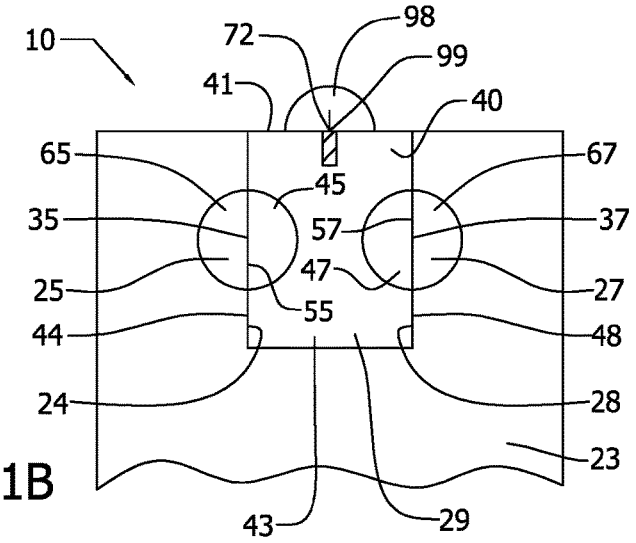
FIG. 1B illustrates by elevation view portions of the exemplary implementation of the sight system of FIG. 1A.

As illustrated in FIG. 1A, rear sight face 23 of rear sight 20 and front sight face 43 of front sight 40 are oriented toward shooter 97 to be viewable by shooter 97 along line of sight 75 when shooter 97 aligns rear sight 20 and front sight 40 with target 98. Rear sight face 23, as illustrated in FIG. 1A, 1B, includes complementary image 25 and complementary image 27. Complementary images 25, 27 are bounded by edge portions 35, 37 of edges 24, 28 of rear sight face 23, respectively, as illustrated. Front sight face 43, as illustrated in FIGS. 1A, 1B, includes image 45 and image 47. Images 45, 47 are bounded by edge portions 55, 57 of edges 44, 48 of front sight face 43, respectively, as illustrated.

Mark 69 on front sight face 43 of front sight 40, as illustrated in FIGS. 1A, 1B, is formed as a rectangular element that extends from a midpoint 71 of front sight top 41 at a right angle with respect to front sight top 41. Thus, mark 69 indicates visually the midpoint 71 of front sight top 41 of front sight 40, and mark 69 may be used to position visually midpoint 71 of front sight 40 with respect to target 98, as illustrated in FIG. 1B. Mark 69 may be of various sizes, shapes, lengths, other proportions, and various color (s), in various other implementations, and mark 69 may be configured to contrast visually with other portions of front sight face 43.

As illustrated in FIG. 1B, when front sight 40 and rear sight 20 are aligned properly with one another and with center 99 of target 98 along line of sight 75, complementary images 25, 27 of rear sight 20 merge visually with images 45, 47 of front sight 40 by juxtaposition of edge portions 35, 37 of edges 24, 28 of rear sight face 23 against edge portions 55, 57 of edges 44, 48 of front sight face 43 to form unitary images 65, 67, respectively, as visually perceived by shooter 97. As visually perceived by shooter 97, mark 69 at front sight top 41 of front sight 40 is centered at center 99 of target 98 concurrent with formation of unitary images 65, 67. Unitary images 65, 67 visually perceived by shooter 97 indicate proper alignment of rear sight 20 with front sight 40, and concurrent visual centering of mark 69 properly aligns rear sight 20 and front sight 40 with center 99 of target 98. Thus, in this implementation, shooter 97 visually aligns complementary images 25, 27 of rear sight 20 with images 45, 47 of front sight 40 to form unitary images 65, 67, respectively, and visually centers mark 69 at center 99 of target 98 to properly align rear sight 20, front sight 40 and target 98 along line of sight 75. Instructor 95 simultaneously views the alignment of rear sight 20, front sight 40, and target 98 by shooter 97 to evaluate shooter's 97 alignment of rear sight 20, front sight 40, and target 98.

Figure 2:
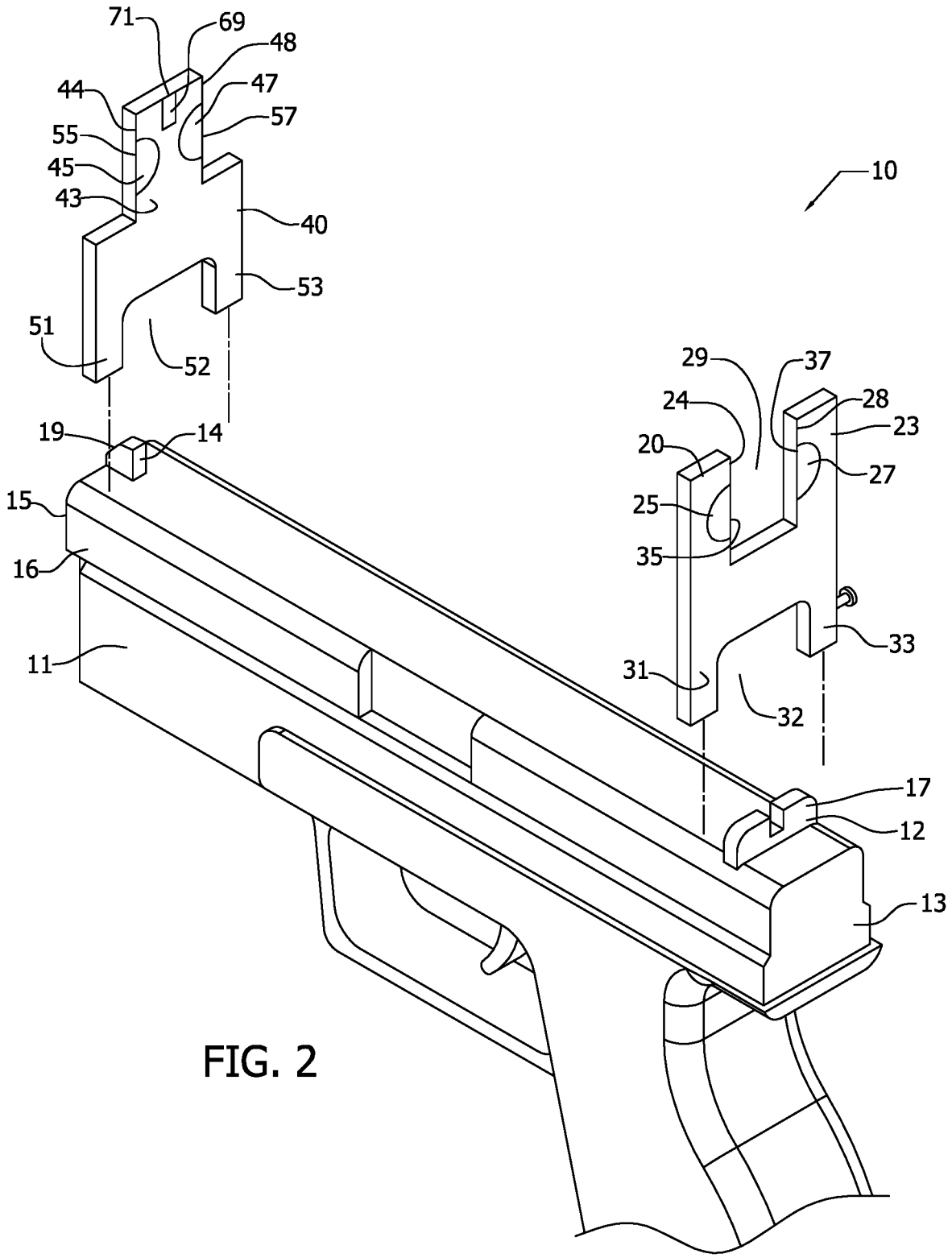
FIG. 2 illustrates by exploded perspective view the exemplary implementation of the sight system of FIG. 1A.

As illustrated in FIG. 2, firearm 11 includes standard rear sight 12 and standard front sight 14 mounted proximate butt 13 and muzzle 15, respectively. Rear sight 20 and front sight 40 are attachable to receiver 16 of firearm 11 proximate standard rear sight 12 and standard front sight 14, respectively, in addition to standard rear sight 12 and standard front sight 14 to substitute for standard rear sight 12 and standard front sight 14. Rear sight face 23 of rear sight 20 and front sight face 43 of front sight 40 are larger than standard rear sight face 17 of standard rear sight 12 and standard front sight face 19 of standard front sight 14, respectively, to be viewed, for example, by shooter 97 simultaneously with instructor 95 along line of sight 75, as illustrated. In various implementations, for example, rear sight face 23 of rear sight 20 may be twice the size of standard rear sight face 17 of standard rear sight 12 and front sight face 43 of front sight 40 may be twice the size of standard front sight face 19 of standard front sight 14.

As illustrated in FIG. 2, rear sight 20 includes arms 31, 33 that define gap 32. Receiver 16 may be inserted into gap 32 to compressibly engage arms 31, 33 of rear sight 20 with receiver 16 to secure rear sight 20 to receiver 16 proximate standard rear sight 12. Similarly, front sight 40 includes arms 41, 43 that define gap 42. Receiver 16 proximate standard front sight 14 may be inserted into gap 42 to compressibly engage arms 41, 43 of front sight 40 with receiver 16 to secure front sight 40 to receiver 16 proximate standard front sight 14.

Figure 3A:
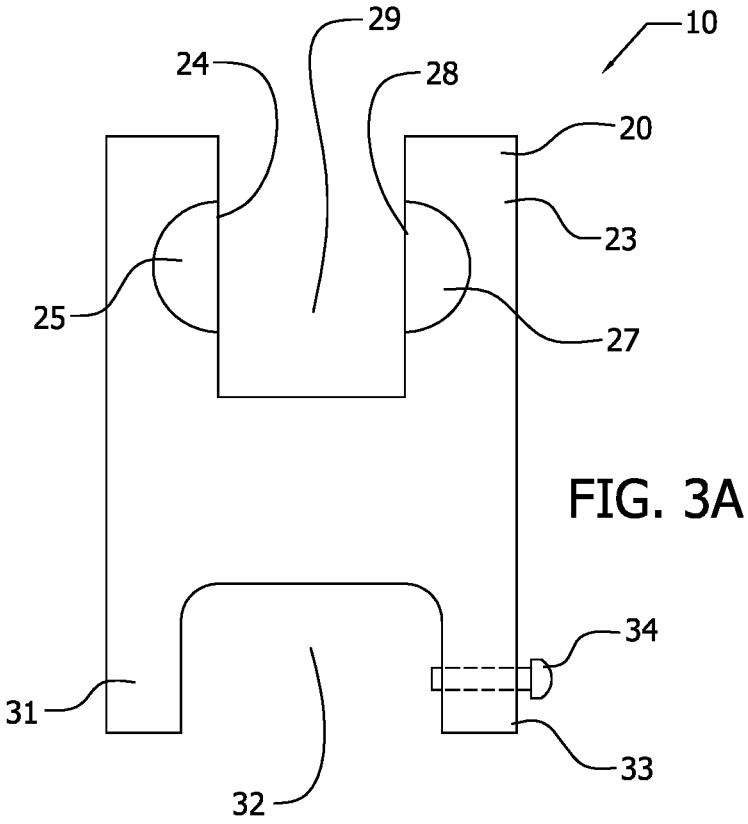
FIG. 3A illustrates by elevation view portions of the exemplary implementation of the sight system of FIG. 1A.
Figure 3B:
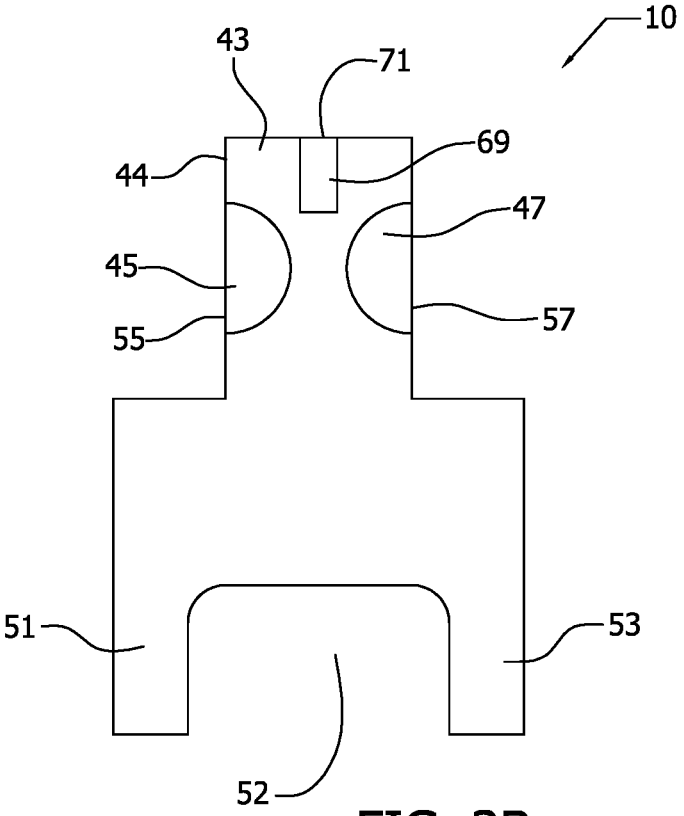
FIG. 3B illustrates by elevation view portions of the exemplary implementation of the sight system of FIG. 1A.

FIGS. 3A, 3B further illustrate rear sight 20 and front sight 40. Front rear sight face 23 of rear sight 20 includes complementary images 25, 27 bounded by complementary edge portions 35, 37 of notch edges 24, 28 of notch 29, respectively, as illustrated in FIG. 3A. Arms 31, 33 that define gap 32 are oriented opposite to notch 29, as illustrated. Note that, in this implementation, fastener 34 passes through arm 33 to engage with receiver 16 to secure rear sight 20 to receiver 16. Of course, any number of fasteners, such as fastener 34, may be disposed about rear sight 20 to secure rear sight 20 to receiver 16, in various implementations. Arms 51, 53 extend forth to define gap 52, as illustrated.

Figure 4:
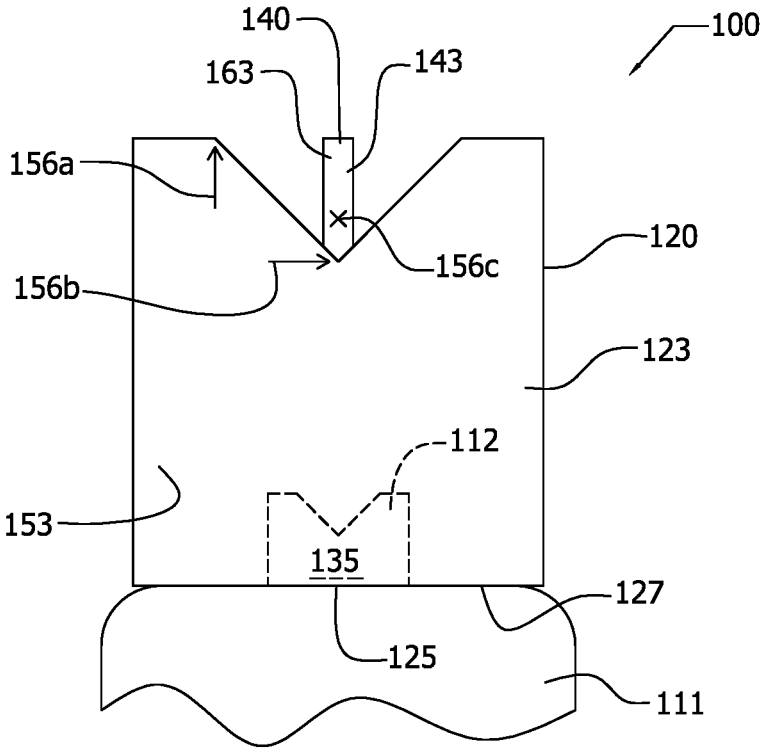
FIG. 4 illustrates by elevation view another exemplary implementation of a sight system according to the present inventions; and, FIG. 5 illustrates by elevation view yet another exemplary implementation of a sight system according to the present inventions.

FIG. 4 illustrates exemplary sight system 100 including rear sight 120 with rear sight face 123 and front sight 140 with front sight face 143. Rear sight 120 and front sight 140 are illustrated in FIG. 4 as visualized by a shooter, such as shooter 97, and an instructor, such as instructor 95, along a line of sight, such as line of sight 75. In this implementation, rear sight 120 is formed as a V-notch and front sight 140 is formed as a post. When properly aligned, the front sight 140 is centered visually in the V-notch with the top of front sight 140 even with the top of rear sight 120, as illustrated in FIG. 4.

As illustrated in FIG. 4, pocket 135 is formed rear sight 120, and pocket 135 is accessible through opening 125 in base 127 of rear sight 120. Rear sight 120 is secured to firearm 111, at least in part, by insertion of standard rear sight 112 through opening 125 into pocket 135, as illustrated in FIG. 4. Pocket 135, as illustrated, is formed to receive insertably standard rear sight 112 and to engage biasingly standard rear sight 112 to secure rear sight 120 to standard rear sight 112, and, thus, secure rear sight 120 to firearm 111, at least in part. As illustrated, pocket 135 is shaped in part as a V to conform to standard rear sight 112 that is formed with a V-notch. It should be recognized that pocket 135 may have other shapes in other implementations to receive insertably other standard rear sights having other shapes. While in this exemplary implementation, both the standard rear sight and rear sight 120 are formed with a V-notch, standard rear sight and rear sight 120 may be formed differently, in other implementations. For example, standard rear sight 112 may be formed as a U-notch and rear sight 120 may be formed as a Patridge sight. Although not shown, front sight 140 may be secured to firearm 111 similarly to rear sight 120. Thus, rear sigh face 123 of rear sight 120 and front sight face 143 of front sight 140 are larger than faces of standard rear sight 112 and standard front sight (not shown), respectively, to be viewed simultaneously, for example, by a shooter and an instructor, such as shooter 97 and instructor 95.

Rear sight face 123 of rear sight 120 forms display surface 153 upon which display elements 156*a*, 156*b* are displayed, as illustrated in FIG. 4. Front sight face 143 of front sight 140 forms display surface 163 upon which display element 156*c* is displayed, as illustrated in FIG. 4. For explanatory purposes, display elements 156*a*, 156*b* are illustrated as arrows pointing to features of rear sight face 123, and display element 156*c* is illustrated as an X that may indicate a feature of front sight 140. Display elements 156*a*, 156*b*, 156*c* may be in the form of, for example, lettering, numbering, symbols, alphanumeric characters, and other graphical elements, in various implementations. Display elements 156*a*, 156*b*, 156*c* may be provided for instructional purposes to indicate various features of rear sight 120 and/or front sight 140. Various numbers and types of display elements may be displayed upon display surfaces 153, 163, in various implementations.

Figure 5:
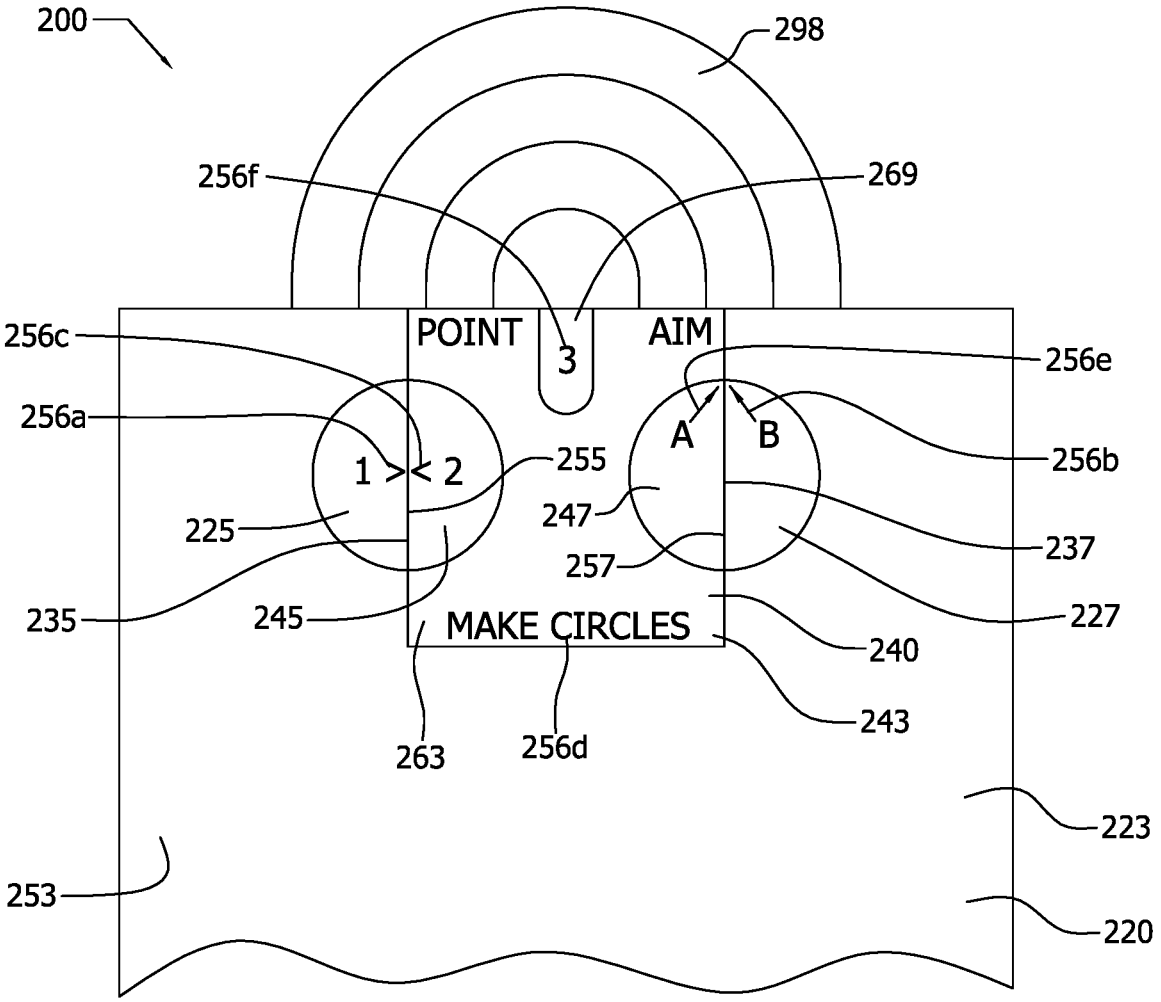

FIG. 5 illustrates exemplary sight system 200 including rear sight 220 with rear sight face 223 and front sight 240 with front sight face 243. Rear sight face 223, as illustrated in FIG. 5, includes complementary image 225 and complementary image 227. Complementary images 225, 227 are bounded by edge portions 235, 237, respectively, as illustrated. Front sight face 243, as illustrated in FIG. 5, includes image 245, image 247, and mark 269. Images 245, 247 are bounded by edge portions 255, 257, respectively, as illustrated. As illustrated in FIG. 5, rear sight 220 is aligned with front sight 240 by juxtaposition of edge portions 235, 237 of rear against edge portions 255, 257 of front sight face 243, respectively, and mark 269 is centered on target 298.

Rear sight face 223 of rear sight 220 forms display surface 253 upon which display elements 256*a*, 256*b* are displayed, as illustrated in FIG. 5. Front sight face 243 of front sight 240 forms display surface 263 upon which display elements 256*c*, 256*d*, 256*e*, 256*f* are displayed, as illustrated in FIG. 5. As illustrated in FIG. 5, display element 256*a* includes characters 1>, display element 256*b* includes characters B→, display element 256*c* includes characters <2, display element 256*d* includes characters MAKE CIRCLES, display element 256*e* includes characters A→, and display element 256*f* includes a character 3. Display elements, such as display elements 256*a*, 256*b*, 256*c*, 256*d*, 256*e*, 256*f*, may be in the form of, for example, alphanumeric character(s), lettering, numbering, symbols, and other graphical elements, in various implementations, and the display elements are sized to be visible to the shooter as the shooter aligns rear sight 220 with front sight 240 and with target 298. Portions of display elements, such as such as display elements 256*a*, 256*b*, 256*c*, 256*d*, 256*e*, 256*f*, may be aligned with one another. For example, as illustrated in FIG. 5, the > portion of display element 256*a* is aligned with the < portion of display element 256*c* and an arrowhead of arrow portion of display element 256*b* is positioned proximate an arrowhead of arrow portion of display element 256*e* to provide additional points of reference to the shooter for use in aligning the rear sight 220 with front sight 240 and target 298. Display element 256*d* comprises words that provide instructions to the shooter, in this implementation. Display element 256*f* comprises a number that indicates a step in the alignment of rear sight 220 with front sight 240 and target 298 for instruction of the shooter, in this implementation.

In operation of a sight system, such as exemplary sight systems 10, 100, 200, a rear sight, such as rear sight 20, 120, 220, and a front sight, such as front sight 40, 140, 240, are secured to a firearm, such as firearm 11, 111. The rear sight and the front sight may be secured to a receiver, such as receiver 16, of the firearm. The rear sight may be secured, at least in part, to a standard rear sight, such as standard rear sight 12, 112, and the front sight may be secured, at least in part, to a standard front sight, such as standard front sight 14. In various implementations, the rear sight and the front sight may be secured, to the firearm by being welded, molded, dove tail, or machined, or by fastener such as a screw or a bolt. In various implementations, the rear sight and the front sight may be clipped over a barrel or frame of the firearm. In various implementations, the rear sight and the front sight may be attached to an accessory rail of the firearm such as a Picatinny rail.

When secured to the firearm, the rear sight and the front sight stand in substitution of the standard rear sight and the standard front sight, respectively. After securement of the rear sight and the front sight to the firearm, a shooter, such as shooter 97, may manipulate the firearm to align visually the rear sight with the front sight and with a target, such as target 98. A rear sight face, such as rear sight face 23, 123, 223, of the rear sight and a front sight face, such as front sight face 43, 143, 243, of the front sight are sized to allow an instructor, such as instructor 95, to view the shooter's alignment of the rear sight, front sight, and target simultaneously with the shooter so that the instructor may evaluate the shooter's alignment of the rear sight, the front sight, and the target. The instructor may then instruct the shooter, for example, in order to improve the shooter's alignment of the rear sight, the front sight, and the target. For example, the instructor may correct the shooter's alignment of the rear sight, the front sight, and the target when the shooter's alignment of the rear sight, the front sight, and the target is improper. Display element(s), such as display element 156*a*, 156*b*, 156*c*, 256*a*, 256*b*, 256*c*, 256*d*, 256*e*, 256*f*, on display surface(s), such as display surface 153, 163, 253, 263, may be used for various instructional purposes. For example, the display elements may instruct the shooter in proper sight alignment and may provide additional points of reference for use in aligning the sights with one another and with the target. In some implementations, the sight system is used for instructional purposes, and the sight system may be secured to the firearm, used for instructional purposes, and then removed from the firearm when not being utilized for instructional purposes. In other implementations, the sight system is used for shooters having visual handicaps such as nearsightedness, farsightedness, or diminished visual acuity, and the sight system is, thus, secured permanently to the firearm.

The foregoing discussion along with the Figures discloses and describes various exemplary implementations. These implementations are not meant to limit the scope of coverage, but, instead, to assist in understanding the context of the language used in this specification and in the claims. The Abstract is presented to meet requirements of 37 C.F.R. § 1.72(b) only. Accordingly, the Abstract is not intended to identify key elements of the apparatus and methods disclosed herein or to delineate the scope thereof. Upon study of this disclosure and the exemplary implementations herein, one of ordinary skill in the art may readily recognize that various changes, modifications and variations can be made thereto without departing from the spirit and scope of the inventions as defined in the following claims.

The invention claimed is:

1. A method of firearm instruction, comprising the steps of:

substituting a rear sight for a standard rear sight and a front sight for a standard front sight by securing the rear sight and the front sight to a firearm, the standard rear sight and the standard front sight remaining secured to the firearm;

aligning the rear sight with the front sight along a line of sight by a shooter manipulating the firearm;

viewing by an instructor simultaneously with viewing by the shooter the aligning of the rear sight with the front sight along the line of sight as the shooter is manipulating the firearm; and wherein a rear sight face of the rear sight and a front sight face of the front sight are sized greater than a standard rear sight face of the standard rear sight and a standard front sight face of the front sight for viewing of the aligning of the rear sight with the front sight along the line of sight by the shooter and by the instructor simultaneously.

2. The method of claim 1, further comprising the step of:

aligning a target with the rear sight and the front sight along the line of sight.

3. The method of claim 1, further comprising the step of:

performing the step of aligning the rear sight with the front sight along a line of sight by visually merging a complementary edge portion of a complementary image with an edge portion of an image thereby forming a unitary image, the complementary image being formed on a portion of the rear sight face of the rear sight and the image being formed on the front sight face of the front sight.

4. The method of claim 3, the step of aligning the rear sight with the front sight along a line of sight further comprising the step of aligning a mark with a target, the mark being formed on the front sight face of the front sight to visually indicate a midpoint of a front sight top of the front sight.

5. The method of claim 1, further comprising the step of:

correcting by the instructor the alignment of the rear sight and the front sight by the shooter.

6. The method of claim 1, further comprising the step of:

instructing the shooter using one or more display elements formed upon a display surface, the display surface forming at least a portion of a rear sight face of the rear sight or a front sight face of the front sight.

7. The method of claim 1, wherein the rear sight is selected from a group consisting of a U-notch, a Patridge, a V-notch, express, and ghost ring.

8. The method of claim 1, wherein the front sight is selected from a group consisting of a post and a post with bead.

9. The method of claim 1, further comprising:

a display surface comprising at least a portion of the rear sight face and the front sight face.

* * * * *